US009583888B2

(12) United States Patent
Yang et al.

(10) Patent No.: US 9,583,888 B2
(45) Date of Patent: Feb. 28, 2017

(54) CONNECTOR HOUSING

(71) Applicant: Tyco Electronics (Shanghai) Co. Ltd., Shanghai (CN)

(72) Inventors: Hongwen Yang, Shanghai (CN); Jian Zhou, Shanghai (CN); Weixiang Ding, Shanghai (CN); Yangrong Xue, Shanghai (CN); Jingwei Shao, Shanghai (CN); Xinbo Liu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 70 days.

(21) Appl. No.: 14/741,607

(22) Filed: Jun. 17, 2015

(65) Prior Publication Data

US 2015/0364850 A1 Dec. 17, 2015

(30) Foreign Application Priority Data

Jun. 17, 2014 (CN) ..... 2014 2 0322658 U

(51) Int. Cl.
*H01R 13/6587* (2011.01)
*H01R 13/659* (2011.01)

(52) U.S. Cl.
CPC ..... *H01R 13/659* (2013.01)

(58) Field of Classification Search
CPC ..... H01R 13/6587; H01R 13/6586; H01R 13/658; H05K 9/0058; H05K 9/002; H05K 9/0007; H05K 9/0083; H05K 9/0084; H05K 9/0088
USPC ..... 439/607.21, 607.2; 174/355, 390, 369, 174/385, 386, 50, 520, 535, 559–562, 174/356, 358, 377, 368; 361/704, 715, 361/729
See application file for complete search history.

(56) References Cited

U.S. PATENT DOCUMENTS 6,724,641 B1 * 4/2004 Hwang ..... G02B 6/4277 174/387
6,878,872 B2 * 4/2005 Lloyd ..... G02B 6/4277 174/366
7,612,299 B2 * 11/2009 Chen ..... H05K 9/0058 174/359
7,869,224 B1 * 1/2011 Yang ..... G02B 6/4284 174/350
8,182,290 B2 * 5/2012 Fonteneau ..... H05K 9/0058 439/607.21

(Continued)

*Primary Examiner* — Gary Paumen
(74) *Attorney, Agent, or Firm* — Barley Snyder

(57) ABSTRACT

A connector housing is provide and includes a single sheet of material, a plurality of first connection members, and a plurality of second connection members. The single sheet of material includes a top wall, a pair of side walls, a bottom wall having a first bottom wall portion and a second bottom wall portion connected to the pair of side walls, and a partition member disposed between the top wall and the bottom wall to partition an inner space defined by the top wall, the pair of side walls and the bottom wall. The plurality of first connection members are disposed along one of the pair of longitudinal edge portions, while the plurality of second connection members are disposed along the other of the pair of longitudinal edge portions. The plurality of first connection members are keyed with the plurality of second connection members, respectively.

21 Claims, 6 Drawing Sheets

(56) References Cited

U.S. PATENT DOCUMENTS

| | | | | |
|---|---|---|---|---|
| 8,203,084 | B2 * | 6/2012 | Wertz, Jr. | H01R 13/6584 174/368 |
| 8,426,751 | B2 * | 4/2013 | Lee | H01R 13/506 174/520 |
| 8,449,331 | B2 * | 5/2013 | Phillips | H01R 13/6581 361/704 |
| 8,613,632 | B1 * | 12/2013 | Nichols | H01R 13/6587 439/485 |
| 8,797,736 | B2 * | 8/2014 | Zhu | G06F 1/187 174/535 |
| 9,035,199 | B2 * | 5/2015 | Janota | H05K 9/0007 174/355 |
| 2004/0246693 | A1 * | 12/2004 | Lloyd | H01R 13/65802 361/800 |
| 2015/0072561 | A1 * | 3/2015 | Schmitt | H01R 13/6587 439/607.55 |

* cited by examiner

CONNECTOR HOUSING

CROSS-REFERENCE TO RELATED APPLICATION

This application claims the benefit of the filing date under 35 U.S.C §119 (a)-(d) of Chinese Patent Application No. 201420322658.X filed on Jun. 17, 2014.

FIELD OF THE INVENTION

The present invention relates to a connector housing and, more particularly, to a connector housing for outer shielding.

BACKGROUND

A known connector housing is shown in FIGS. 1 and 2, and generally includes an upper housing 10, a lower housing 20 and a partition member 30. As shown, the upper housing 10, the lower housing 20 and the partition member 30 are individual pieces separated from one another. Accordingly, the known connector housing require at least individual pieces. This known connector housing is generally provided with multi-ports configuration. As shown, an inner receiving space of the connector housing is divided into two insertion ports, which are disposed side by side in the same layer, by the partition member 30.

These known connector housings (also named as a connector cage or a shielding housing of a connector), which have the upper housing 10, the lower housing 20 and the partition member 30 separated from one another, generally have poor structural strength that may lead to structural cracks. Furthermore, if the insertion port has a parallelogram configuration, and four side walls forming the parallelogram constitute separate four-part configuration, connector housing exhibits a parallelogram effect, i.e., the ports of the connector housing swing towards two sides of the connector housing. Also, it is hard to control the dimension of each member with respect to assembling the connector housing. In addition, a rubber shield ring may be scratched due to sharp protrusions apt to be formed on the ports of the connector housing.

Furthermore, complex steps are required to assemble the upper housing 10, the lower housing 20 and the partition member 30, which are separated from one another, which results in poor manufacturing efficiency and difficulty in achieving efficient automatic machining process.

SUMMARY

According to one aspect of the present invention, a connector housing is provide and includes a single sheet of material, a plurality of first connection members, and a plurality of second connection members. The single sheet of material includes a top wall, a pair of side walls, a bottom wall having a first bottom wall portion and a second bottom wall portion connected to the pair of side walls, and a partition member disposed between the top wall and the bottom wall to partition an inner space defined by the top wall, the pair of side walls and the bottom wall. The plurality of first connection members are disposed along one of the pair of longitudinal edge portions, while the plurality of second connection members are disposed along the other of the pair of longitudinal edge portions. The plurality of first connection members are keyed with the plurality of second connection members, respectively.

BRIEF DESCRIPTION OF THE DRAWINGS

The invention will be explained in greater detail in the following with reference to embodiments, referring to the appended drawings, in which.

DETAILED DESCRIPTION OF THE EMBODIMENT(S)

Figure 1:
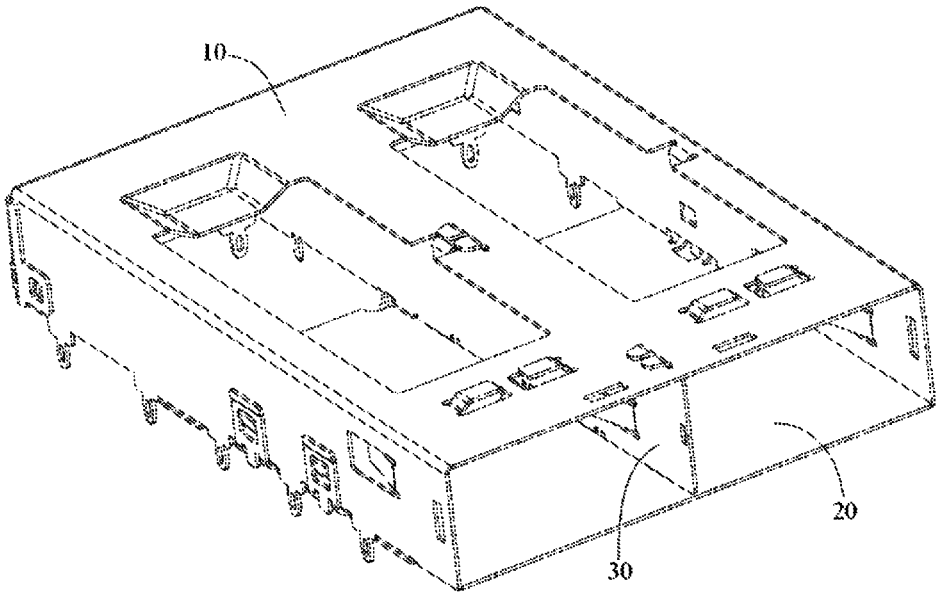
FIGURE 1 PRIOR ART
FIG. 1 is a perspective view of a known connector housing.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 3:
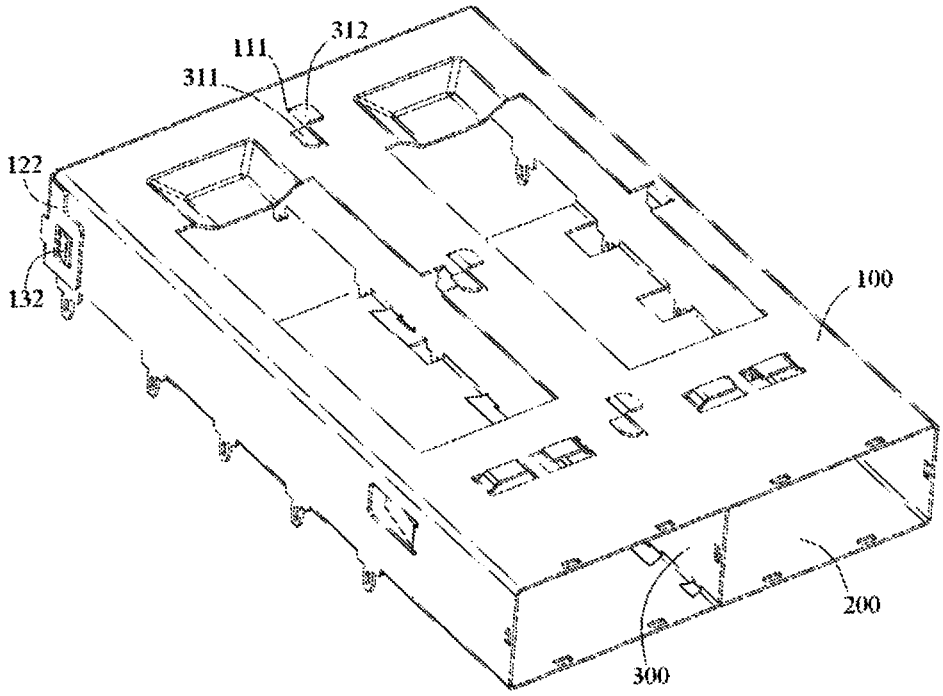
FIG. 3 is a perspective view of a connector housing with two insertion ports according to the invention.

According to a general concept of the present invention, as shown in FIG. 3, a connector housing, according to the invention, generally includes an upper housing 100, a lower housing 200 and a partition member 300.

Figure 4:
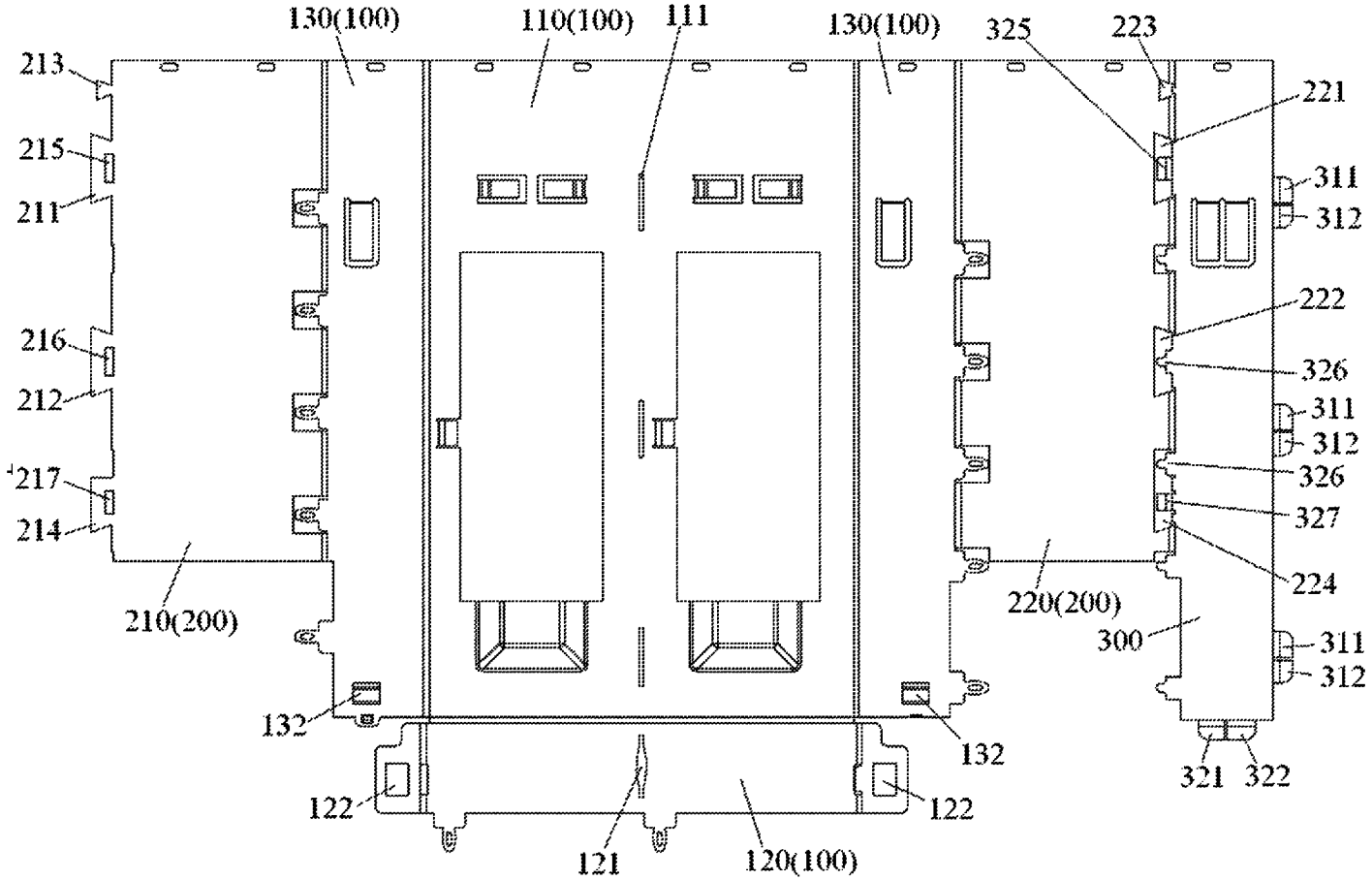
FIG. 4 is a top plan view of the connector housing of FIG. 3 prior to assembly.

Specifically, as shown in FIGS. 3 and 4, the lower housing 200 is located beneath the upper housing 100. The upper housing 100 includes a top wall 110 and a pair of side walls 130, 130. The lower housing 200, or bottom wall, includes a first bottom wall portion 210 and a second bottom wall portion 220 that form a bottom wall of the connector housing. The first bottom wall portion 210 and the second bottom wall portion 220 are connected with the pair of side walls 130, 130, respectively. In this way, an inner space is defined by the top wall 110, the pair of side walls 130, and the bottom wall 200.

The partition member 300 is disposed between the top wall 110 and the bottom wall 200 to partition the inner space into two insertion ports. The two insertion ports are arranged side by side and extend in a longitudinal direction parallel with the top wall 110 or bottom wall 200 of the connector housing.

The upper housing 100 further includes a rear end wall 120 integrally connected a rear end of the top wall 110 to cover rear end openings of the two insertion ports.

As shown in FIGS. 3 and 4, the partition member 300 is disposed vertically in the inner space of the connector housing. An upper edge portion of the partition member 300 is detachably connected with the top wall 110 (to be described in detail hereafter), and a lower edge portion of the partition member 300 is integrally connected with the bottom wall 200 (to be described in detail hereafter).

As shown in FIG. 4, the top wall 110, the pair of side walls 130, 130, the rear end wall 120, the bottom wall 200 and the partition member 300 are formed into a single piece.

Figure 5:
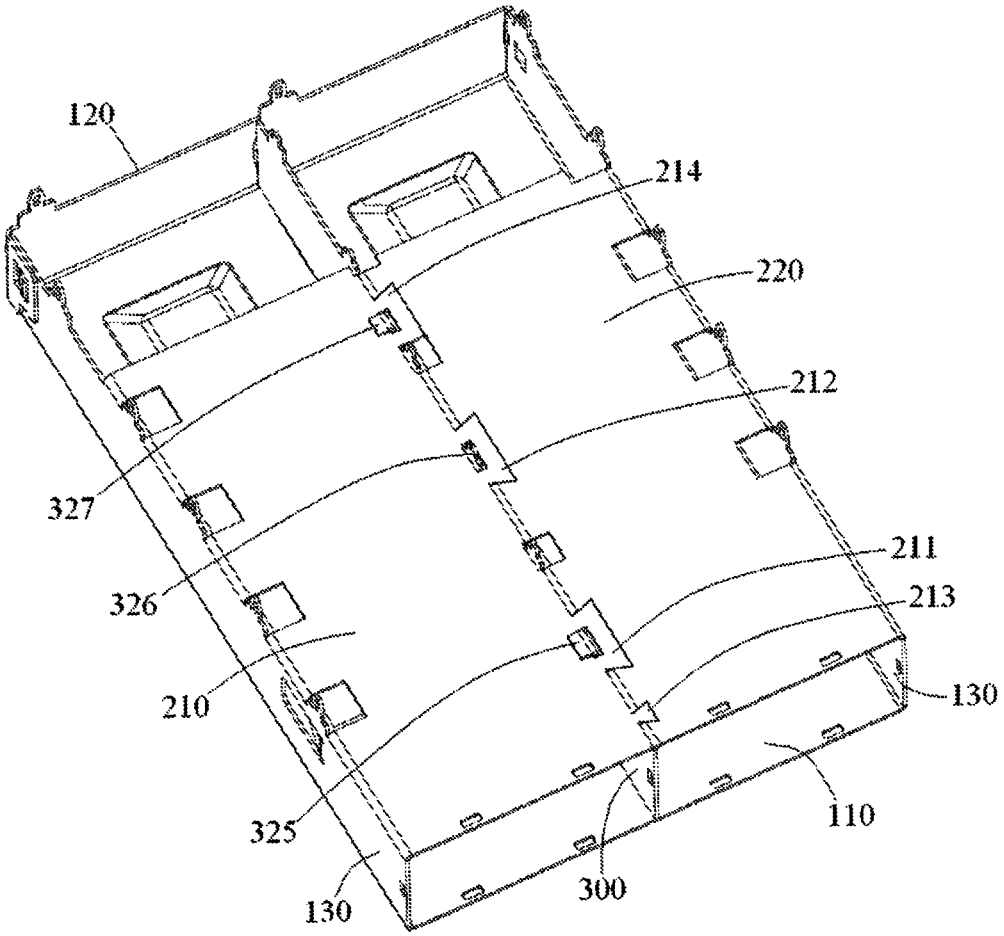
FIG. 5 is a bottom plan view of the connector housing of FIG. 3 after assembly.
Figure 6:
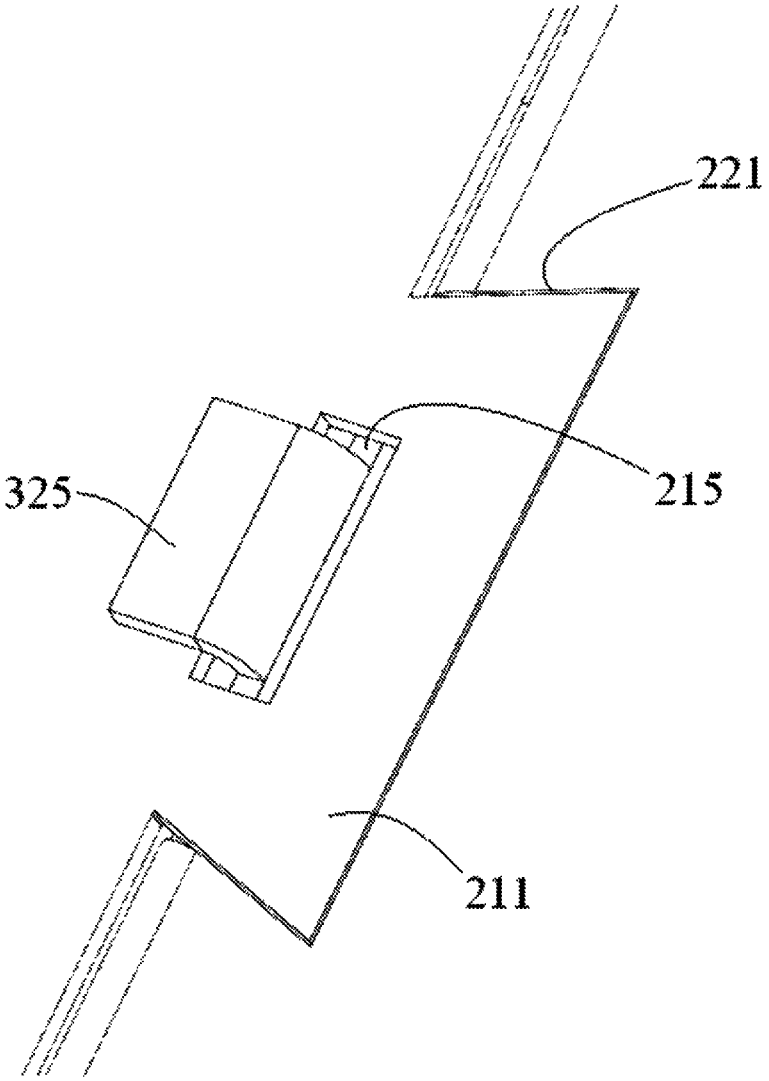
FIG. 6 is an enlarged perspective view of the connector housing of FIG. 3, showing a dovetail tab and a dovetail receiving passageway engaged with each other, and a connection tongue and a third member receiving passageway engaged with each other.

As shown in FIGS. 4, 5 and 6, the first and second bottom wall portions 210, 220 of the bottom wall 200 have a pair of longitudinal edge portions facing to and separated from each other. A plurality of first connection members are provided on the longitudinal edge portion of one of the first and second bottom wall portions 210 and 220, and a plurality of second connection members are provided along the longitudinal edge portion of the other of the first and second bottom wall portions 210 and 220. The first connection members are mated with the second connection members, respectively, so that the pair of separated longitudinal edge portions of the first and second bottom wall portions 210 and 220 is connected together.

The first connection members include a plurality of dovetail tabs 211, 212, 213, 214, and the second connection members include a plurality of dovetail receiving passageways 221, 222, 223, 224 mated with the plurality of dovetail tabs 211, 212, 213, 214 respectively. In the shown embodiment, the plurality of dovetail tabs 211, 212, 213, 214 are provided on the longitudinal edge portion of the first bottom wall portion 210, and the plurality of dovetail receiving passageways 221, 222, 223, 224 are provided in the longitudinal edge portion of the second bottom wall portion 220.

As shown in FIGS. 4, 5 and 6, in the embodiment shown, the dovetail tabs 211, 212 have shapes and/or sizes approximately identical to each other, but different from that of the dovetail tab 213 and the dovetail tab 214. Furthermore, the shape and the size of the dovetail tab 213 are different from that of the dovetail tab 214. Similarly, as shown in FIGS. 4, 5 and 6, the dovetail receiving passageways 221, 222 have shapes and/or sizes approximately identical to each other, but different from that of the dovetail receiving passageway 223 and the dovetail receiving passageway 224. Furthermore, the shape and the size of the dovetail receiving passageway 223 are different from that of the dovetail receiving passageway 224. Thus, via engagement between various dovetail tabs and dovetail receiving passageways with different shapes and/or sizes, the pair of separated longitudinal edge portions of the first bottom wall portion 210 and the second bottom wall portion 220 is efficiently and reliably connected with each other to prevent movement between each other.

In the shown embodiment, as shown in FIGS. 4, 5 and 6, the connector housing further includes third connection members formed on the lower edge portion of the partition member and at positions where the dovetail receiving passageways 224 are located, respectively, as well as plurality of third member receiving passageways 215, 216, 217 formed in the dovetail tabs 211, 212, 214, the third connection members passing through the third member receiving passageways, respectively. Specifically, the partition member 300 is connected with the longitudinal edge portion of the second bottom wall portion 220 formed with the plurality of dovetail receiving passageways. The third member receiving passageways 215, 216, 217 are provided in the dovetail tabs 211, 212, 214, respectively, and the third connection members 325, 326, 327, passing through the third member receiving passageways 215, 216, 217 of the dovetail tabs 211, 212, 214, respectively, are provided on the lower edge portion of the partition member 300. Thus, via the engagement between the plurality of third connection members 325, 326, 327 and the plurality of third member receiving passageways 215, 216, 217, the pair of separated longitudinal edge portions of the first bottom wall portion 210 and the second bottom wall portion 220 is reliably connected with each other to prevent movement between each other.

As clearly shown in FIG. 4, since the one dovetail tab 213 and one corresponding dovetail receiving passageway 223 have a smaller size, no third member receiving passageways are provided on the one dovetail tab 213. It is appreciated that strength of the one dovetail tab 213 will be decreased if a third member receiving passageway is provided on the smaller dovetail tab 213.

In the embodiment shown in FIGS. 4, 5 and 6, four dovetail tabs 211, 212, 213, 214 spaced from each other are provided on the longitudinal edge portion of the first bottom wall portion 210. Similarly, four dovetail receiving passageways 221, 222, 223, 224 spaced from each other and mated with the four corresponding dovetail tabs 211, 212, 213, 214, respectively, are provided in the longitudinal edge portion of the second bottom wall portion 220.

It should be noted that the present invention is not limited to the embodiment illustrated, for example, the number of the dovetail tabs and the dovetail receiving passageways are not limited to four as illustrated, it may be one, two, three, five or more. In addition, the shapes and/or sizes of the dovetail tabs and the dovetail receiving passageways are not limited to the embodiment illustrated, and they may be changed as necessary.

In the embodiment shown in FIGS. 4, 5 and 6, the plurality of third connection members 325, 326, 327 include two bendable connection tongues 325, 327, which are constructed to pass through the third member receiving passageways 215, 217 of the dovetail tabs 211, 214, respectively, and are then bent and pressed against an outer surface of the first bottom wall portion 210.

In the embodiment shown in FIGS. 4, 5 and 6, the plurality of third connection members 325, 326, 327 further include at least one insertion pin 326 that is provided on the lower edge portion of the partition member 300, and is inserted into a circuit board (not shown) for mounting the connector housing thereof, after passing through the third member receiving passageway 216 of the dovetail tab 212.

Referring back to FIGS. 3 and 4, a plurality of a pair of first bendable connection lugs 311, 312 are provided on the upper edge portion of the partition member 300 away from the second bottom wall portion 220. A plurality of first lug receiving passageways 111 are provided and are to be mated with the plurality of a pair of first bendable connection lugs 311, 312 that are provided in the top wall 110. Each pair of first bendable connection lugs 311, 312 passes through one corresponding first lug receiving passageway 111, and is then bent and pressed against the outer surface of the top wall 110, to connect the partition member 300 to the top wall 110.

As shown in FIG. 3, in order to connect the partition member 300 to the top wall 110 more reliably, each pair of first bendable connection lugs 311, 312 are bent in opposite directions and pressed against the outer surface of the top wall 110.

As shown in FIGS. 3 and 4, the plurality of a pair of first bendable connection lugs 311, 312 are regularly spaced from each other. Thereby, it is possible to ensure even load and improve structure strength of the whole connector housing.

Further, a pair of second bendable connection lugs 321, 322 is provided on one end of the partition member 300 adjacent to the rear end wall 120. A second lug receiving passageway 121 is provided and to be mated with the pair of second bendable connection lugs 321, 322 that are provided in the rear end wall 120. The pair of second bendable connection lugs 321, 322 passes through the second lug receiving passageway 121, and is then bent and pressed against the outer surface of the rear end wall 120, to connect the partition member 300 to the rear end wall 120.

As shown in FIG. 3, in order to connect the partition member 300 to the rear end wall 120 more reliably, each pair of second bendable connection lugs 321, 322 are bent in opposite directions and pressed against the outer surface of the rear end wall 120.

As shown in FIGS. 3 and 4, a protrusion 132 is provided on one end of each side wall 130 adjacent to the rear end wall 120. Additionally, a bendable connection piece is provided on one end of the rear end wall 120 adjacent to each side wall 130. The connection piece is bent and then snap-fit with the protrusions 132 by a protrusion receiving passageway 122 formed in the connection pieces, to connect the pair of side wall 130 to the rear end wall 120.

As shown in FIG. 4, the whole connector housing may be formed by folding a single metal plate as shown in FIG. 4.

In an embodiment of the invention, the single metal plate as shown in FIG. 4 may be formed by punching at one time, i.e., a piece of raw plate may be punched at one time to form the upper housing 100, the lower housing 200, the partition member 300 and all other necessary structures, which constitute the whole connector housing.

In the embodiment shown in FIGS. 3-6, the whole connector housing may be formed by punching a single metal plate at one time, thus simplifying the manufacturing and assembling processes, improving level of automation, facilitating mass production, and improving manufacturing efficiency.

In addition, in the embodiment shown in FIGS. 3-6, since the whole connector housing is formed into a single piece, the whole connector housing is improved, and dimension accuracy of each insertion port is reliably ensured.

Figure 2:
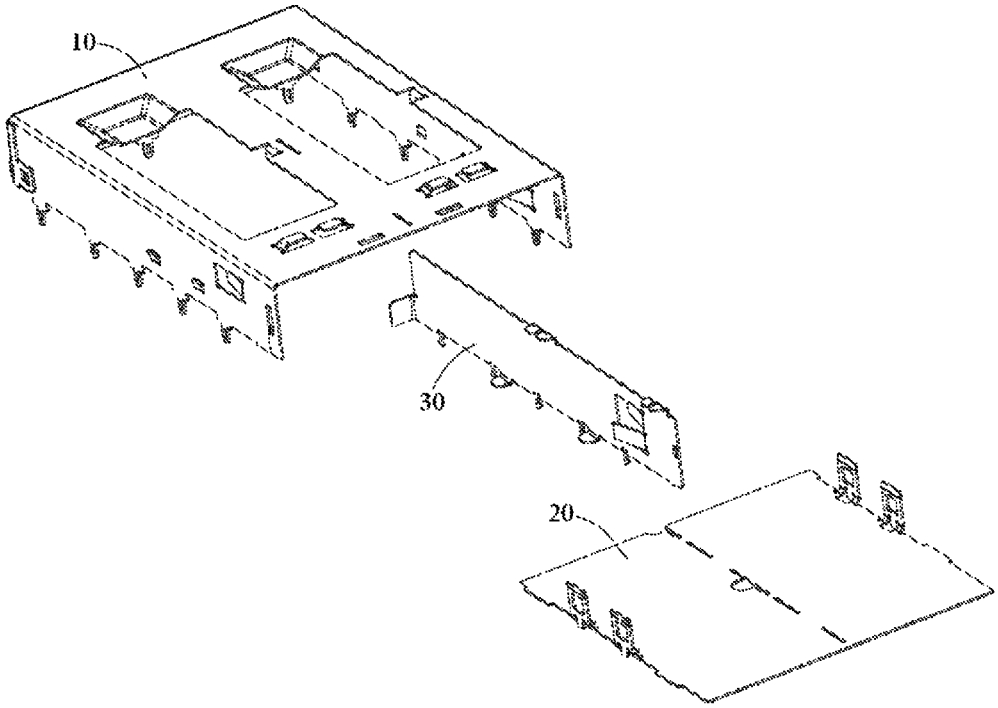
FIGURE 2 PRIOR ART
FIG. 2 is an exploded view of the known connector housing of FIG. 1.

The connector housing according to the aforementioned discussed embodiments has less structural members, for example, only one than the known design in FIGS. 1 and 2. Overall, in the connector housing, assembly is simplified, cost of manufacturing is reduced and high strength and stability is achieved through a simplified design.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed:

1. A connector housing, comprising:

a single sheet of material, having:

a top wall;

a pair of side walls;

a bottom wall having a first bottom wall portion and a second bottom wall portion connected to the pair of side walls, respectively, the first and second bottom wall portions having a pair of longitudinal edge portions facing to and separated from each other; and a partition member disposed between the top wall and the bottom wall to partition an inner space defined by the top wall, the pair of side walls and the bottom wall into two insertion ports, a plurality of first connection members disposed along one of the pair of longitudinal edge portions; and a plurality of second connection members disposed along the other of the pair of longitudinal edge portions;

wherein the plurality of first connection members are keyed with the plurality of second connection members, respectively.

2. The connector housing according to claim 1, further comprising a rear end wall integrally connected a rear end of the top wall.

3. The connector housing according to claim 2, wherein the plurality of first connection members include a plurality of dovetail tabs spaced from each other.

4. The connector housing according to claim 3, wherein the plurality of second connection members include a plurality of dovetail receiving passageways spaced from each other and connectable with the plurality of dovetail tabs.

5. The connector housing according to claim 4, wherein at least two dovetail tabs of the plurality of dovetail tabs are shaped or sized different from each other.

6. The connector housing according to claim 5, wherein at least two dovetail receiving passageways of the plurality of dovetail receiving passageways are shaped or sized different from each other.

7. The connector housing according to claim 4, further comprising a plurality of third connection members disposed along a lower edge portion of the partition member and at positions corresponding with the plurality of dovetail receiving passageways.

8. The connector housing according to claim 7, further comprising a plurality of third member receiving passageways disposed in the plurality of dovetail tabs and configured to receive the plurality of third connection members passing there through.

9. The connector housing according to claim 8, wherein the plurality of third connection members include bendable connection tongues.

10. The connector housing according to claim 8, wherein the plurality of third connection members include a circuit board insertion pin.

11. The connector housing according to claim 10, further comprising a plurality of first bendable connection lugs disposed on an upper edge portion of the partition member.

12. The connector housing according to claim 11, further comprising a plurality of first lug receiving passageways provided along the top wall and keyed to mate with the plurality of a pair of first bendable connection lugs.

13. The connector housing according to claim 12, wherein a pair of the plurality of first bendable connection lugs passes through a corresponding first lug receiving passageway of the plurality of first lug receiving passageways, and is then bent to press against an outer surface of the top wall.

14. The connector housing according to claim 13, wherein each pair of the plurality of first bendable connection lugs are bent in opposite directions.

15. The connector housing according to claim 14, wherein the plurality of first bendable connection lugs are regularly spaced from each other.

16. The connector housing according to claim 15, further comprising a plurality of second lug receiving passageways provided along the top wall and keyed to mate a the plurality of second bendable connection lugs.

17. The connector housing according to claim 16, wherein each of the plurality of second bendable connection lugs pass through a corresponding second lug receiving passageway of the plurality of second lug receiving passageways, and is then bent to press against the outer surface of the top wall.

18. The connector housing according to claim 17, wherein each of the plurality of second bendable connection lugs are bent in opposite directions.

19. The connector housing according to claim 18, further comprising a protrusion disposed at one end of each side wall of the pair of side walls and positioned adjacent to the rear end wall.

20. The connector housing according to claim 1, wherein the single sheet of material is a single plate of metal.

21. The connector housing according to claim 20, wherein the single plate of metal is formed by one punching process.

* * * * *